US005625281A

United States Patent [19]

Lambert

[11] Patent Number: 5,625,281

[45] **Date of Patent: *Apr. 29, 1997**

[54] LOW-VOLTAGE MULTI-OUTPUT CURRENT MIRROR CIRCUIT WITH IMPROVED POWER SUPPLY REJECTION MIRRORS AND METHOD THEREFOR

[75] Inventor: Craig N. Lambert, San Jose, Calif.

[73] Assignee: Exar Corporation, San Jose, Calif.

[ * ] Notice: The term of this patent shall not extend beyond the expiration date of Pat. No. 5,512,816.

[21] Appl. No.: 491,465

[22] Filed: Jun. 16, 1995

Related U.S. Application Data

[63] Continuation-in-part of Ser. No. 398,235, Mar. 3, 1995, Pat. No. 5,512,816.

[51] Int. Cl.[6] ..... G05F 3/16

[52] U.S. Cl. ..... 323/315; 323/316

[58] Field of Search ..... 323/312, 315, 323/316, 317; 330/257, 258; 327/542, 543, 538

[56] References Cited

U.S. PATENT DOCUMENTS

| | | | |
|---|---|---|---|
| 4,462,002 | 7/1984 | Schade, Jr. | 330/253 |
| 4,503,381 | 3/1985 | Bowers | 323/315 |
| 4,525,683 | 6/1985 | Jason | 320/288 |
| 4,647,841 | 3/1987 | Miller | 323/316 |
| 5,089,769 | 2/1992 | Petty et al. | 323/316 |
| 5,179,355 | 1/1993 | Harvey | 330/265 |
| 5,245,273 | 9/1993 | Greaves et al. | 323/313 |
| 5,420,542 | 5/1995 | Harvey | 330/292 |

*Primary Examiner*—Matthew V. Nguyen

*Attorney, Agent, or Firm*—Townsend and Townsend and Crew LLP

[57] ABSTRACT

A circuit technique for improving power supply rejection of current mirror circuits having multiple outputs. An input reference current is preadjusted for error caused by power supply variations and then mirrored through a cascade of current mirror circuits. In one embodiment an opamp loop forces the output of a current mirror circuit to be substantially equal to the reference current. This current is then used in subsequent mirroring stages to obtain various outputs. The circuit eliminates the need for including an error-subtraction transistor at every output.

10 Claims, 7 Drawing Sheets

LOW-VOLTAGE MULTI-OUTPUT CURRENT MIRROR CIRCUIT WITH IMPROVED POWER SUPPLY REJECTION MIRRORS AND METHOD THEREFOR

This invention is a continuation in part of commonly-assigned U.S. Pat. application Ser. No. 08/398,235, filed Mar. 3, 1995, U.S. Pat. No. 5,512,816, for low-voltage current mirror circuit with improved power supply rejection and method therefor.

BACKGROUND OF THE INVENTION

The present invention relates in general to integrated circuits and in particular to current source circuits with improved power supply rejection.

Current sources are typically used in integrated circuits to set up the DC operating point (or biasing condition) of the circuit. The output of a current source is replicated (or multiplied by a factor) by current mirror circuits throughout a given circuit. As most of the operational parameters of a circuit depend on the DC operating point of that circuit, maintaining a constant bias condition is critical to the operation of the circuit. For example, it is often desirable to maintain a constant bias current even if the circuit power supply voltage varies. The ability of a circuit to resist changes in its operational parameters due to power supply voltage variations is commonly referred to as power supply rejection.

FIG. 1A shows an example of a mirroring current source circuit in bipolar technology. The current $I_1$ is set by current source 100 which is typically a resistive element that is connected between a power supply independent voltage and a diode-connected transistor Q1. This current is mirrored by transistors Q1 and Q2 to generate $I_2$, and mirrored again by transistors Q3 and Q4 to generate the output current $I_{out}$. Variations in the power supply voltage of a conventional current mirror circuit such as the one depicted in FIG. 1A causes the output current $I_{out}$ to change. This is due to the fact that the collector current of a bipolar transistor increases slowly with increasing collector-emitter voltage. The mirrored current can be mathematically approximated using the following equations:

$$I_2 = I_1\left(1+\frac{V_{CE_{Q2}}}{V_{A_N}}\right)$$

$$I_{out} = I_2\left(1+\frac{V_{CE_{Q4}}}{V_{AP}}\right) = I_1\left(1+\frac{V_{CE_{Q2}}}{V_{AN}}\right)\left(1+\frac{V_{CE_{Q4}}}{V_{AP}}\right)$$

where $V_{CE}$ is the collector-emitter voltage of the indicated transistor and $V_{AN}$ and $V_{AP}$ are the Early voltages of the NPN and PNP transistors, respectively. Given a typical $V_{CE}$ value of 3 volts and an Early voltage of 30 V, $I_{out}$ would be more than 20% higher than $I_1$. Thus, an error current results from what is referred to as the Early effect.

The collector-emitter voltage $V_{CE}$ is the power supply dependent term in the above equation. The impact of the $V_{CE}$ term can be minimized by maximizing the output impedance $R_{out}$ of the transistors in the circuit. That is, the power supply rejection of a typical current mirror is proportional to the output impedance, $R_{out}$, of the transistors in the circuit. Higher output impedance results in higher power supply rejection. For the circuit shown in FIG. 1A, the output impedance of transistors Q2 and Q4 determine the level of power supply rejection. The output impedance of a transistor depends upon the fabrication process and the transistor geometry. With increasing emphasis on higher speed circuit fabrication processes, transistor sizes will continue to shrink. The smaller base widths of bipolar transistors and shorter gate lengths of field-effect transistors result in lower output impedances for these devices. Lower $R_{out}$ increases the circuit vulnerability to power supply variations.

Various techniques have been employed to increase the power supply rejection of a current mirror circuit. One approach is to increase device geometries (base widths or gate lengths). Increasing device geometries can be an option with MOSFETs or JFETs (longer channels) or with lateral bipolar transistors, because it can be readily implemented at the layout phase of the circuit (i.e., it does not require adjustments to the process). Longer base widths in vertical bipolar transistors, however, requires a longer and probably richer base diffusion. This requires a process change and may not even be feasible due to speed requirements for other transistors in the circuit. Also, many circuits are developed on general-purpose arrays of transistors. In such cases, the circuit designer does not have the freedom to adjust device geometries.

Another approach uses resistive degeneration to increase the effective output impedance. FIG. 1B shows the current mirror circuit of FIG. 1A with emitter degeneration resistors $R_e$. The value for the output impedance $R_{out}$ of the current source in FIG. 1B is given by:

$$R_{out} = \left(\beta\frac{R_e}{R_e + r_\pi + r_b + R_s} + 1\right)R_o$$

$\beta$=common-emitter current gain of the transistors $R_e$=emitter degeneration resistance $r_\pi = (\beta kT) / (qI_B)$ $r_b$=intrinsic base resistance $R_S$=source impedance If $R_e$ can be made large enough to dominate the denominator of the above equation, the output impedance of the current source can be approximately equal to $\beta R_O$, almost always an acceptably large value. Thus, emitter degeneration works well if the emitter resistor $R_e$ can be made large enough. With any significant output current from the current source, however, the voltage dropped across the emitter resistor can become too large to permit the use of this technique in a low voltage circuit. Thus, resistive degeneration is not a satisfactory solution for low voltage (e.g., around 3 volts) applications.

Another circuit technique to increase output impedance employs cascode devices. A well-known example of this circuit is the Wilson mirror circuit shown in FIG. 1C. A cascode device can provide very high output impedance, but it has the same limitation as the emitter degeneration resistor. That is, the voltage required for the operation of this circuit is increased by one $V_{BE}$ (base-emitter turn-on voltage of the cascode transistors) for each mirror. In the example of FIG. 1C, the voltage requirement of the circuit increases by 2 $V_{BE}$. This is often more than the voltage that is available in the circuit.

A preferred technique for increasing the power supply voltage rejection of a cascaded current mirror while maintaining the low voltage operation is disclosed in the commonly-assigned U.S. patent application Ser. No. 08/398,235. There, the error current caused by the Early effect is detected, replicated, and then subtracted from the output current. FIG. 2 is a simplified circuit diagram of the low voltage current mirror circuit with improved power supply rejection. As fully described in the referenced U.S. patent application, block 204 generates the error current $I_{err}$, which is mirrored by block 208 and subtracted from the output current $I_{out}$. The error current subtraction cancels the impact of supply voltage variations. The circuit therefore exhibits improved power supply rejection.

One drawback of the error subtraction technique is that there is a subtraction transistor Q210 required for each output. That is, in those applications where the same reference current (I1 in FIG. 2) is to be used for generating multiple output currents, the subtraction transistor 210 must be repeated for each output. FIG. 3 shows the error subtraction technique applied to a cascaded current mirror with multiple outputs. It is shown that error subtraction transistors Q210, Q311, Q312, and Q313 must connect to the output nodes at the collector terminals of transistors Q212, Q314, Q315, and Q316, respectively. The number of additional transistors required to provide the correction increases linearly with the number of outputs. For a large number of outputs, this can quickly increase the size of the circuit.

It is therefore desirable to increase the power supply rejection of low voltage multiple output cascaded current mirror circuits without unduly increasing the circuit size.

SUMMARY OF THE INVENTION

The present invention provides an improved method and circuit for increasing power supply rejection in low voltage cascaded current mirror circuits having multiple outputs.

According to one embodiment, the present invention provides a method and a circuit for preadjusting the current to be mirrored by the amount of the error current. The preadjusted current is then used in a cascaded current mirror circuit to generate multiple output currents. Subsequent mirroring at the multiple outputs would therefore not require a subtraction circuit.

In another embodiment, a differential amplifier is connected in a feedback loop between the reference current circuit and a first output current. The differential amplifier loop operates to force the bias voltages of the initial current mirroring stage to be equal. The output of the amplifier is used to bias a current adjusting circuit that tweaks the amount of current to be mirrored, in response to the differential input, to equal the reference current.

A better understanding of the nature and advantages of the multiple output, low voltage current mirror circuit of the present invention may be had by referring to the following drawings and the detailed description.

DESCRIPTION OF THE PREFERRED EMBODIMENT

Figure 2:
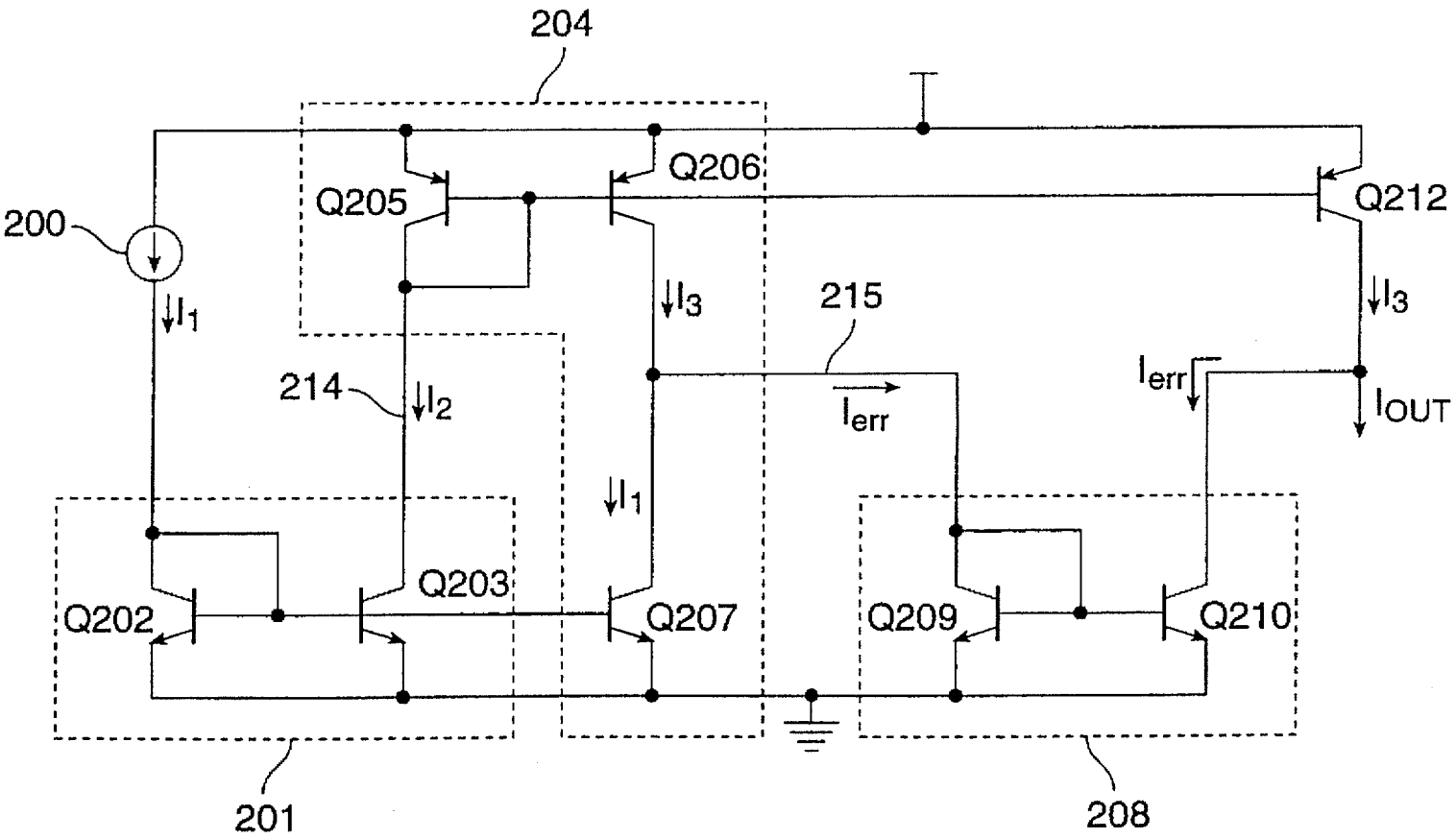
FIG. 2 is a simplified circuit diagram of a low voltage current mirror circuit using an error subtraction technique.
Figure 3:
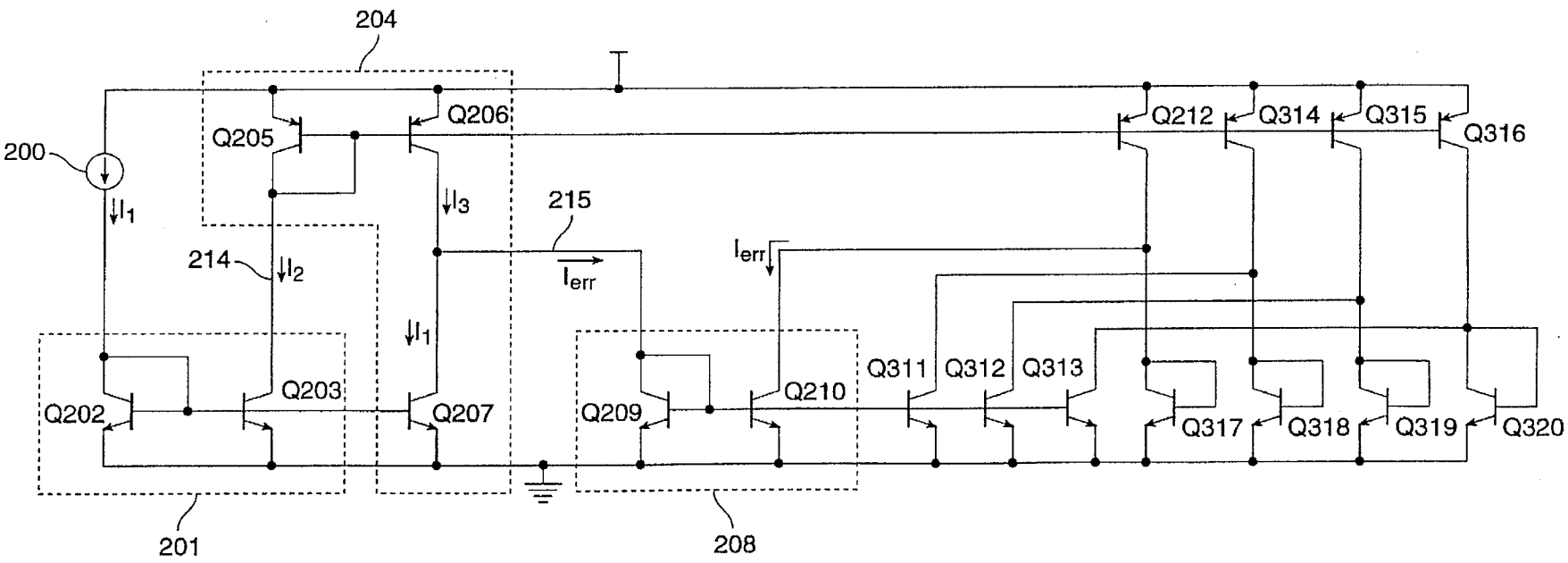
FIG. 3 is a schematic of a current mirror circuit having multiple outputs based on the error subtraction technique.
Figure 4:
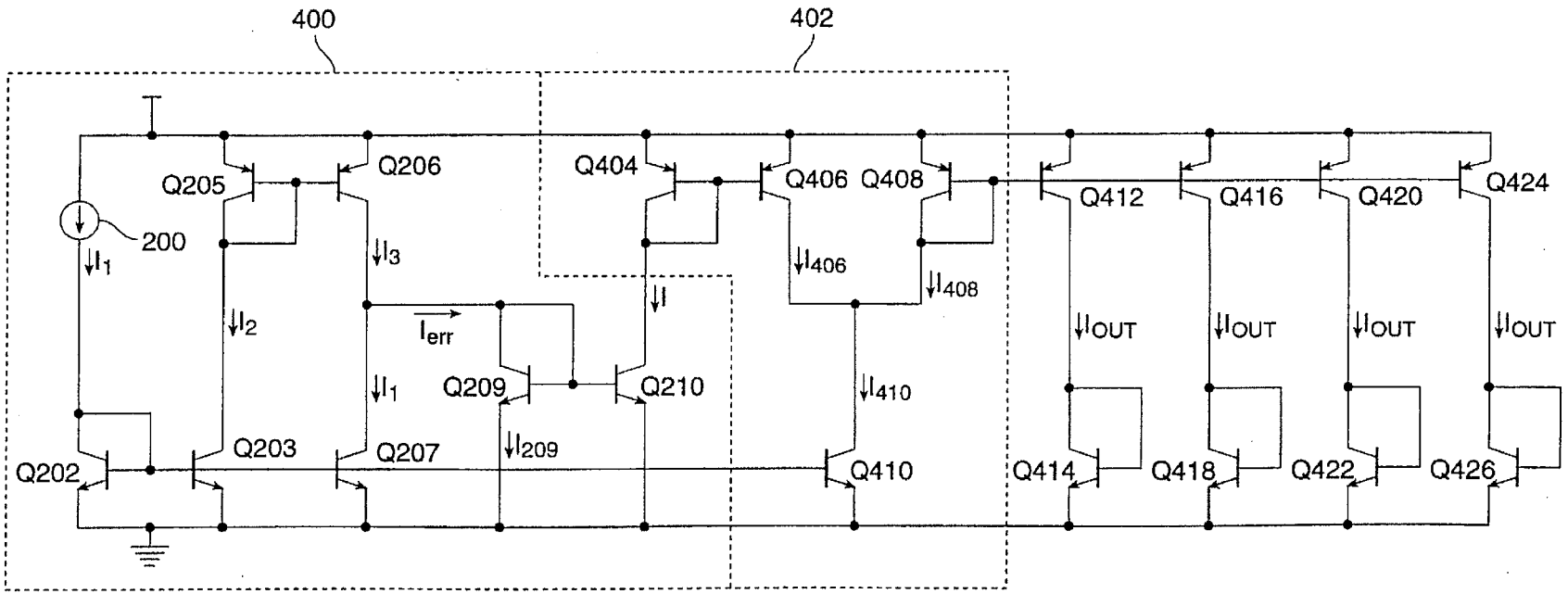
FIG. 4 shows an improved multiple-output low voltage current mirror circuit according to one embodiment of the present invention.

Referring to FIG. 4 there is shown a first embodiment for a more economical alternative to the multiple output cascaded current source of FIG. 3. A simple current mirror circuit without the use of buffered mirroring or emitter degeneration is used to illustrate the principles of operation. Block 400 is identical to the error current generation and subtraction circuit of FIG. 2 with the same circuit elements being identified by the same reference numerals. However, instead of repeating the current subtraction circuit for every output as in FIG. 3, the circuit of FIG. 4 preadjusts the amount of current to be mirrored by circuit 402 and then mirrors it at the various outputs.

The current mirror circuit made up of transistors Q404 and Q406, mirrors the error current $I_{err}$ at the collector terminal of Q406 ($I_{406}$). The transistor Q408 clamps the collector voltage of transistor Q406 to the same voltage as the collector voltage of Q404. Thus, the current mirror circuit including transistors Q404 and Q406 is not impacted by the Early effect since the $V_{CE}$ of both transistors are equal. Accordingly, $I_{406}$ is an accurate replica of the error current $I_{err}$. The current $I_{410}$ at the collector terminal of transistor Q410 is an uncorrected mirror of the reference current I1. The uncorrected mirror current $I_{410}$ equals the sum of the collector currents of transistors Q404 and Q408 (i.e., $I_{404}+I_{408}$). Thus, the current $I_{408}$ equals the uncorrected mirrored current $I_{410}$ minus an amount of current ($I_{406}$) equal to the error current $I_{err}$. It is this adjusted current $I_{408}$ that is used in subsequent current mirror circuits to generate the output mirror currents.

Comparing the size of this circuit with that of FIG. 3 shows that for five or more outputs, the circuit of FIG. 4 uses fewer transistors. Every output of the circuit of FIG. 3 requires two transistors (one output transistor and one correction transistor), while the circuit of FIG. 4 uses only one transistor (the output transistor). Thus, the overhead of the error-sensing and correction circuitry 402 is offset after five outputs.

The correction provided by the circuit of FIG. 4, however, is not as accurate as that of FIG. 3. As fully described in the related U.S. patent application Ser. No. 08/398,235, the error subtraction technique of FIG. 3 results in an ideal correction for the Early effect. It was shown mathematically that an exact replica of the error term is subtracted from the output. In the circuit of FIG. 4, however, the proper correction is not a subtraction, but a division:

$$I_{out}=I_{408}\,(1+V_{CEP}/V_{AP})$$

where $V_{CEP}$ is the collector-emitter voltage of any of the output PNP transistors (Q412, Q416, Q420, or Q424). Thus, to obtain ideal cancellation, $I_{408}$ must equal:

$$I_{408}=I_{410}-I_{406}=I1/(1+V_{CEP}/V_{AP})$$

The actual correction however, is derived as follows:

$$I_{err}=I3-I1=I_{209}=[I1*(1+V_{CE203}/V_{AN})*(1+V_{CE206}/V_{AP})]-I1$$

$$I_{406}=I_{404}=I_{err}*(1+V_{CE210}/V_{AN})$$

$$I_{410}=I1*(1+V_{CE410}/V_{AN})$$

$$I_{408}=I_{410}-I_{406}=(I-I_{err})*(1+V_{CEN}/V_{AN})$$

where, $V_{CEN}$ in this equation is the collector-emitter voltage of an NPN (Q210 or Q410) transistor. Replacing the above equation for $I_{err}$ in the equation for $I_{408}$ yields:

$$I_{408}=(1+V_{CEN}/V_{AN})*(I1-I1*(1+V_{CEN}/V_{AN})*(1+V_{CEP}/V_{AP})+I1)$$

$$I_{408}=I1*(1+V_{CEN}/V_{AN})*(2-(1+V_{CEN}/V_{AN})*(1+V_{CEP}/V_{AP}))$$

The output current at the collector terminals of any one of the transistors Q412, Q416, Q420, or Q424 is therefore given by:

$$I_{out}=I_{408}*(1+V_{CEP}/V_{AP})=I1*(1+V_{CEN}/V_{AN})*(1+V_{CEP}/V_{AP})[2-(1+V_{CEN}/V_{AN})*(1+V_{CEP}/V_{AP})]$$

This can be further simplified as:

$$I_{out}=I1*[2(1+V_{CEN}/V_{AN})(1+V_{CEP}/V_{AP})-(1+V_{CEN}/V_{AN})^2(1+V_{CEP}/V_{AP})^2]$$

Figure 5:
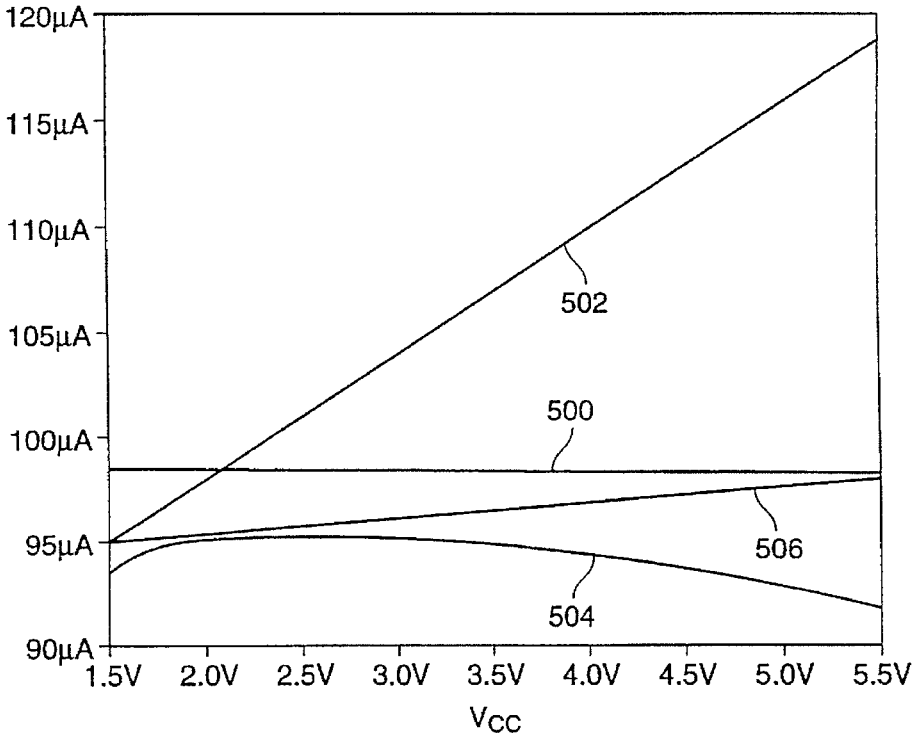
FIG. 5 compares measured power supply rejection for various current mirror circuits including the embodiment shown in FIG. 4.

This results in a correction that is very good, but not ideal, as shown in FIG. 5. FIG. 5 illustrates the comparative performance of the power supply rejection of the various circuits. Line 500 is the target current I1. 502 is an uncorrected output current derived from a conventional current mirror circuit such as the one depicted in FIG. 1. 504 is the corrected output current $I_{out}$ as derived from the circuit of FIG. 4, and 506 is the output current of a conventional current mirror circuit whose voltage dependance is controlled by about 200 mV of emitter degeneration (i.e., with small emitter degeneration resistors). The curvature of line 504 (or the $I_{out}$ current) results from the second-order terms in the last equation above. It can be seen from FIG. 5 that the circuit of FIG. 4 realizes much better performance than the uncorrected circuit, but offers no advantage over conventional current mirror circuits using emitter degeneration (e.g., FIG. 1B). For those circuits in which emitter degeneration resistors may not be available, however, this embodiment of the present invention provides appreciable improvement in power supply rejection. Such circuits may include semi-custom or array type circuits that do not provide enough resistors of the proper size for adequate degeneration.

Figure 6:
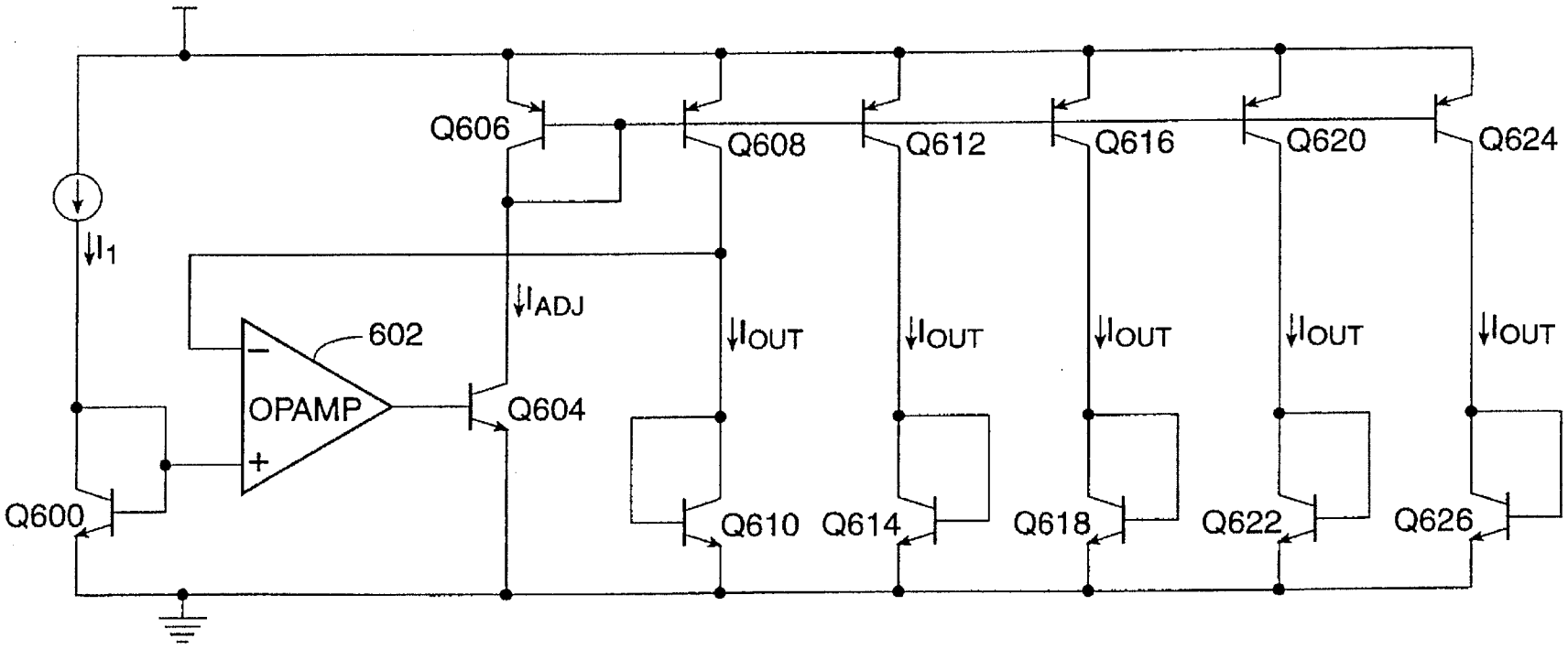
FIG. 6 is a circuit block diagram of a further improved second embodiment of the current mirror circuit of the present invention.

In a second embodiment, the present invention provides further improvement in the performance of the low voltage current mirror circuit. FIG. 6 is a circuit block diagram of the second embodiment that operates based on the pre-correction principle but offers much improved performance. Referring to FIG. 6, the reference current I1 flows in diode-connected transistor Q600, producing a $V_{BE}$ in accordance with the ideal diode law. That voltage is applied as a reference to the non-inverting input of an operational amplifier (opamp) 602. The output of opamp 602 drives the base terminal of transistor Q604 that is used to produce current through transistor Q606, the reference transistor that establishes the base-emitter voltage that is used in a number of mirror transistors (Q608, Q612, Q616, Q620, Q624) to provide output currents. The output current $I_{608}$ of the first mirror transistor Q608 establishes the base-emitter voltage $V_{BE610}$ of the diode-connected transistor Q610. Transistor Q610 has the identical size and layout as that of transistor Q600. The base terminal of transistor Q610 is connected to the inverting input of the opamp 602 and therefore $V_{BE610}$ is monitored by the inverting input of the opamp 602. In response to the difference between the voltages across the two diodes Q600 and Q610, the output of the opamp 602 increases or decreases the current into the base terminal of transistor Q604. Thus, the differential opamp loop operates to force the same amount of current to flow through the collector terminals of transistors Q600 and Q610. The opamp 602 accomplishes this by adjusting the current through transistor Q604 to equal $I1/(1+V_{CE608}/V_A)$, such that when mirrored by transistor Q608, the output current $I_{608}$ equals the reference current I1.

Figure 1A:
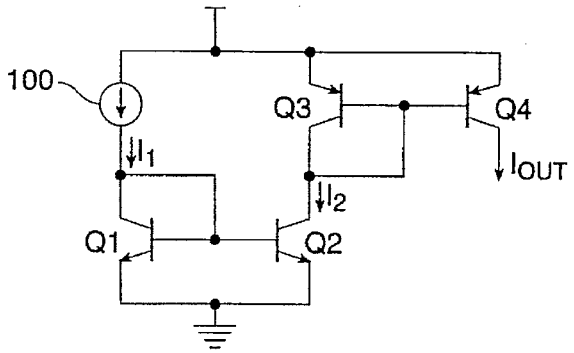
FIG. 1A PRIOR ART
FIGS. 1A, 1B, and 1C show prior art embodiments of current mirror circuits.
Figure 1B:
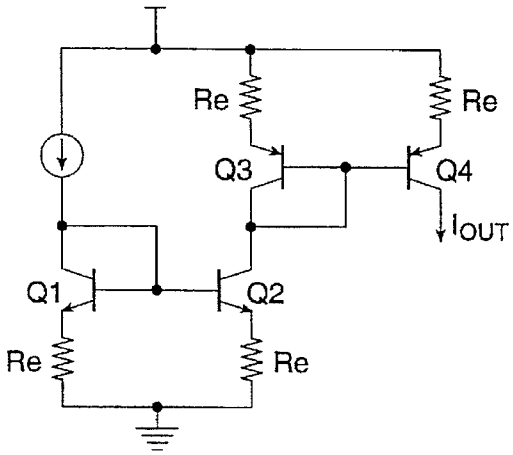
FIG. 1B PRIOR ART
Figure 1C:
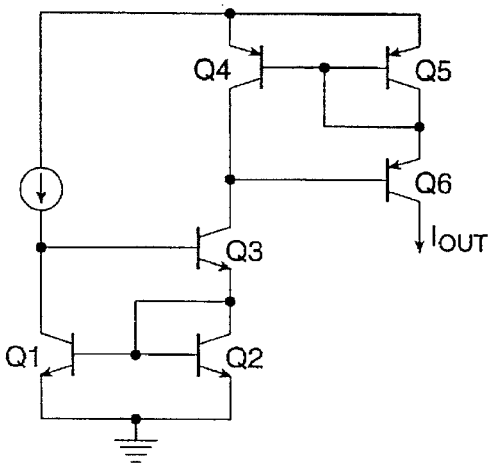
FIG. 1C PRIOR ART
Figure 7:
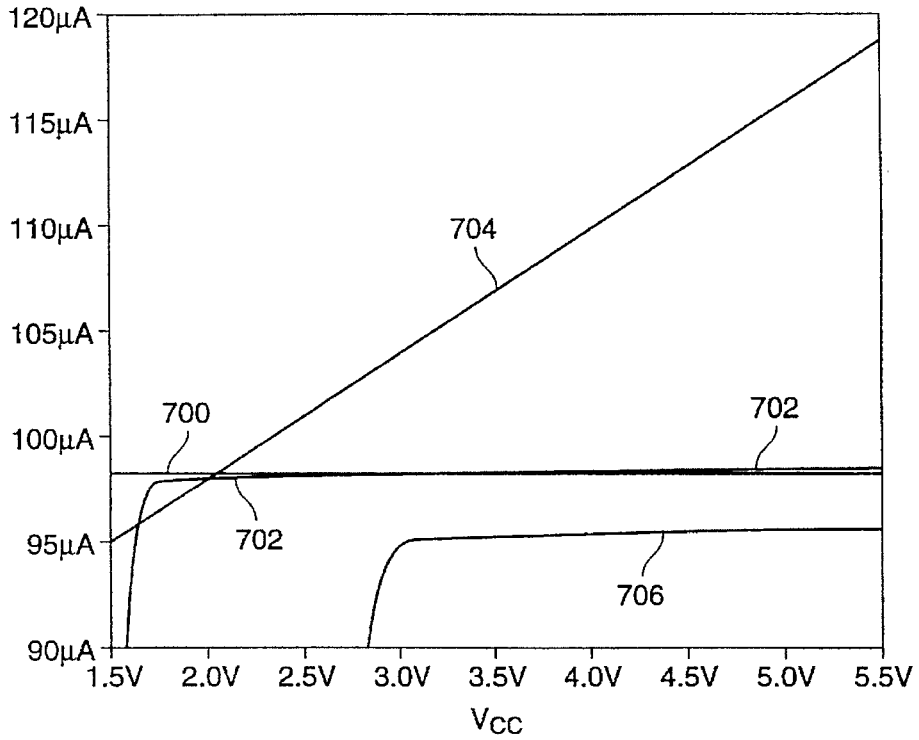
FIG. 7 illustrates measured improvements in the power supply rejection of the second embodiment of the current mirror circuit of the present invention.

FIG. 7 illustrates a comparative performance of the power supply rejection of the various circuits. Line 700 is the target output current (i.e., the reference current I1), and line 702 is an output current of the circuit of FIG. 6. The uncorrected output current as would be provided by the conventional current mirror circuits depicted in FIG. 1 is shown by line 704, and an output current corrected by an amount of emitter degeneration required to obtain the correction provided by the circuit of FIG. 6 is shown by line 706. It is shown that the output current of the circuit of the present invention (702) has a distinct advantage over the uncorrected case (704) in terms of accuracy, and over the degeneration-corrected case (706) in the terms of low-voltage (<3V) operation. The circuit of the present invention operates at power supply voltages as low as about 1.7 volts and nearly perfectly replicates the reference current I1. There are two factors that impact the accuracy of the circuit of FIG. 6, opamp offset and reference transistors mismatch. Any offset voltage will increase or decrease the output current of all of the current outputs, but will not affect the voltage coefficient of the currents. The voltage coefficient of the output currents is reduced by the power supply rejection of the opamp 602. Thus, to maximize the circuit performance, the offset of the opamp 602 must be minimized, the matching between transistors Q600 and Q604 maximized, and the power supply rejection of opamp 602 maximized.

Figure 8:
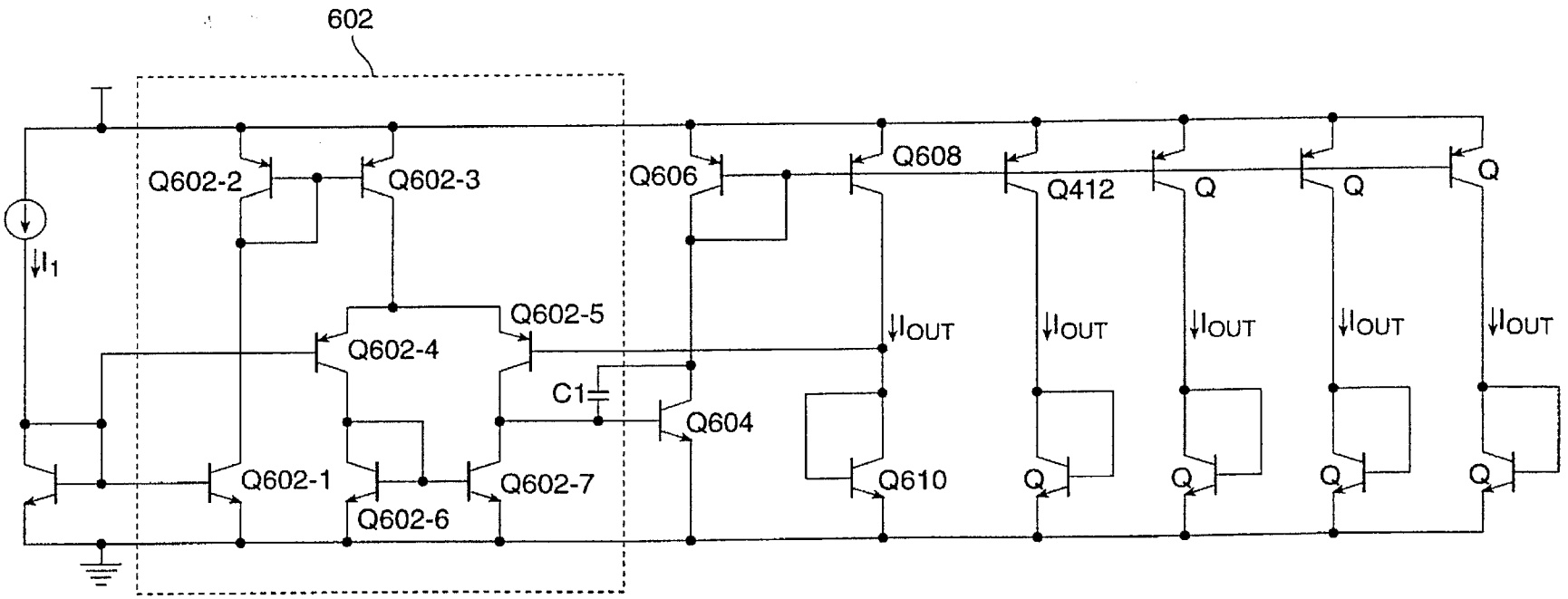
FIG. 8 is a circuit diagram of the second embodiment of the present invention depicted in greater detail.

FIG. 8 is a circuit diagram of the second embodiment of the present invention showing one example of the internal circuitry of the opamp 602. The opamp 602 includes bias transistors Q602-1 and Q602-2, current source transistor Q602-3, input transistors Q602-4 and Q602-5, load transistors Q602-6 and Q602-7, and compensation capacitor C1. This allows a comparison of the sizes of the circuits using the two different techniques of error subtraction (FIG. 3) and mirror current preadjustment (FIG. 8). The circuit of FIG. 3 adds three error-current generation transistors (Q206, Q207, and Q209) plus an additional error-current subtraction transistor (Q210) for every output current. The circuit of FIG. 8, on the other hand, adds a fixed number of transistors, seven for the opamp 602 and two (Q608 and Q610) to generate the preadjusted current to be mirrored. Compensation capacitor C1 can be kept small if the current from current source Q602/Q603 is small. This shows that a cascaded current mirror circuit with more than six output terminals would be smaller in size using the preadjustment technique of the present invention as compared to the circuit using the error subtraction technique.

In conclusion, the present invention provides an improved method and a circuit technique for significantly reducing output current variations in multi-output current mirror circuits caused by power supply variations. The technique of the present invention allows current mirror circuits to operate at lower voltages with higher power supply rejection. For those cascaded current mirror circuit with a larger number of output terminals, the circuit of the present invention offers a technique that reduces the size of the circuit. While the above is a complete description of several embodiments of the present invention, it is possible to use various alternatives, modifications and equivalents. For example, the same techniques can be applied to current mirror and reference circuits using MOSFET technology or a combination of bipolar and MOSFET technologies. Also, the circuits of FIGS. 4, 6, and 8 can be implemented with complementary bipolar transistors where the output currents are obtained from a collector terminal of an NPN mirroring transistor and the diode-connected output transistor is a PNP transistor. Current mirror transistors can also be implemented using the buffered mirror approach in which an emitter follower transistor connects the collector and base terminals of a transistor to form a diode-connected transistor, and may include emitter degeneration resistors. Therefore, the scope of the present invention should be determined not with reference to the above description but should, instead, be determined with reference to the appended claims, along with their full scope of equivalents.

What is claimed is:

1. A circuit comprising:

a current source providing a reference current (I1);

a first current mirror circuit coupled to said current source, said first current mirror circuit having an output current (I2);

an error current generator coupled to said first current mirror circuit, said error current generator generating at an output an error current ($I_{err}$) representative of the difference between an expected value of (I1) and an actual value of (I1);

a second current mirror circuit coupled to said output of said error current generator for replicating said error current ($I_{err}$); and a current adjusting circuit coupled to said error current generator and said first current mirror circuit, said current adjusting circuit generating at an output a current substantially equal to said reference current (I1), or a designed multiple thereof.

2. The circuit of claim 1 wherein said error current generator comprises:

a third current mirror circuit coupled to said first current mirror circuit, said third current mirror circuit having an output current (I3) at an output; and a first reference current mirror transistor coupled to said output of said third current mirror circuit, wherein, said first reference current mirror transistor subtracts an amount of current substantially equal to said input current (I1) from said current (I3) to generate said error current ($I_{err}$).

3. The circuit of claim 2 wherein said current adjusting circuit comprises:

a fourth current mirror circuit coupled to said error current generator for duplicating a current substantially equal to said error current ($I_{err}$) at an output node;

a diode-connected transistor coupled to said output node to clamp a voltage at said output node at one diode drop; and a second reference current mirror transistor coupled to said output node and, wherein, at said output node, an output current of said diode-connected transistor is substantially equal to an uncorrected mirror of said reference current flowing through said second reference current mirror transistor minus said error current flowing through said fourth current mirror circuit.

4. A circuit comprising:

a current source providing a reference current (I1) through a first diode-connected transistor;

an amplifier having a first input coupled to said first diode-connected transistor;

a current adjust transistor having a control terminal coupled to an output of said amplifier;

a current mirror circuit coupled to said current adjust transistor; and a second diode-connected transistor coupled to an output of said current mirror circuit and a second input of said amplifier, wherein, a current through said current adjust transistor is adjusted by said amplifier such that a current flowing through said output of said current mirror is forced to be substantially equal to said reference current.

5. The circuit of claim 4 wherein said first and second diode-connected transistors are a matched pair of transistors having substantially identical size and layout.

6. The circuit of claim 5 further comprising a plurality of mirror transistors coupled to said current mirror circuit, each one of said plurality of mirror transistors being coupled to a diode-connected load transistor.

7. The circuit of claim 5 wherein all transistors are field effect transistors.

8. The circuit of claim 5 wherein transistors are selectively implemented in field effect transistor technology and bipolar transistor technology.

9. The circuit of claim 5 wherein said amplifier is an operational amplifier comprising:

a differential pair of input transistors having control terminals coupled to said first and second amplifier inputs, respectively;

a current source transistor coupled to said differential pair of input transistors; and a pair of load transistors respectively coupled to said differential pair of input transistors.

10. A method for increasing the power supply rejection of current mirror circuits comprising the steps of:

(a) generating a reference current through a first transistor;

(b) coupling said first transistor to a first input of an amplifier;

(c) adjusting a current flowing through a second transistor by applying an output of said amplifier to said second transistor;

(d) mirroring said current flowing through said second transistor with a current mirror circuit;

(e) coupling said current mirror circuit to a third transistor; and (f) coupling said third transistors to a second input of said amplifier.

* * * * *